US006991494B1

(12) United States Patent
Spink, Jr.

(10) Patent No.: US 6,991,494 B1
(45) Date of Patent: Jan. 31, 2006

(54) PANEL MOUNT CABLE CONNECTOR ASSEMBLY

(75) Inventor: William E. Spink, Jr., Woodland Hills, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/901,514

(22) Filed: Jul. 28, 2004

(51) Int. Cl.
*H01R 13/648* (2006.01)

(52) U.S. Cl. ..... 439/607; 439/76.1

(58) Field of Classification Search ..... 439/607, 439/604, 610, 76.1
See application file for complete search history.

(56) References Cited

U.S. PATENT DOCUMENTS 5,975,958 A 11/1999 Weidler
6,030,242 A 2/2000 Cunningham et al.
6,231,383 B1 5/2001 Hwang
6,241,555 B1 6/2001 Okuyama et al.
6,494,744 B1 * 12/2002 Lee ..... 439/610

* cited by examiner

*Primary Examiner*—Ross Gushi
(74) *Attorney, Agent, or Firm*—Wei Te Chung

(57) ABSTRACT

A cable connector assembly (100) includes an electrical connector (1) including an insulative housing (10), a number of conductive contacts (12) received in the insulative housing and a conductive shield (11) enclosing the insulative housing, a cable (5) including a number of lines (520, 522), a printed circuit board (4) electrically connecting the conductive contacts of the electrical connector with the lines of the cable, and a shielding member (2) electrically connecting with the electrical connector and secured with the printed circuit board and the cable. The shielding member forms a number of deflecting members (212) for securing to a panel (3) and a number of anti-stress members for preventing the deflecting members from excessive deformation.

18 Claims, 8 Drawing Sheets

PANEL MOUNT CABLE CONNECTOR ASSEMBLY

BACKGROUND OF THE INVENTION

1. Field of the Invention

The present invention generally relates to a cable connector assembly, and more particularly to a panel mount cable connector assembly.

2. Description of Related Art

A panel mount cable connector assembly located in a chassis of a computer usually comprises an insulative housing, a plurality of conductive contacts received in the housing, a cable electrically connecting with the conductive contacts. A front portion of the insulative housing is configured to engage with a panel of a chassis and is exposed beyond the panel for engaging with a complementary connector. U.S. Pat. No. 6,030,242 discloses such a panel mount cable connector assembly. However, when the cable connector assembly needs to transmit high speed signals, grounding becomes an important issue. U.S. Pat. No. 5,975,958 discloses a panel mount connector engaging with a panel through a capacitive coupling adapter and electrically connecting with a printed circuit board in a chassis. Thus, the panel mount connector is grounded to resist against electromagnetic interference and discharge. However, the structure of the capacitive coupling adapter is relatively complex and cost consuming. In addition, the structure of the panel mount connector is not suitable for a panel mount cable connector assembly.

Hence, a cable connector assembly with improved grounding means is highly desired to overcome the disadvantages of the prior art.

SUMMARY OF THE INVENTION

Accordingly, an object of the present invention is to provide a cable connector assembly with better high speed signal transmitting effect.

In order to achieve the object set forth, a cable connector assembly in accordance with the present invention comprises an electrical connector comprising an insulative housing, a plurality of conductive contacts received in the insulative housing and a conductive shield attaching to the insulative housing, a cable comprising a plurality of lines, a printed circuit board electrically connecting the conductive contacts of the electrical connector with the lines of the cable, and a shielding member electrically connecting with the electrical connector and secured with the printed circuit board and the cable. The shielding member forms a plurality of deflecting members for securing to a panel and a plurality of anti-stress members for preventing the deflecting members from excessive deformation.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
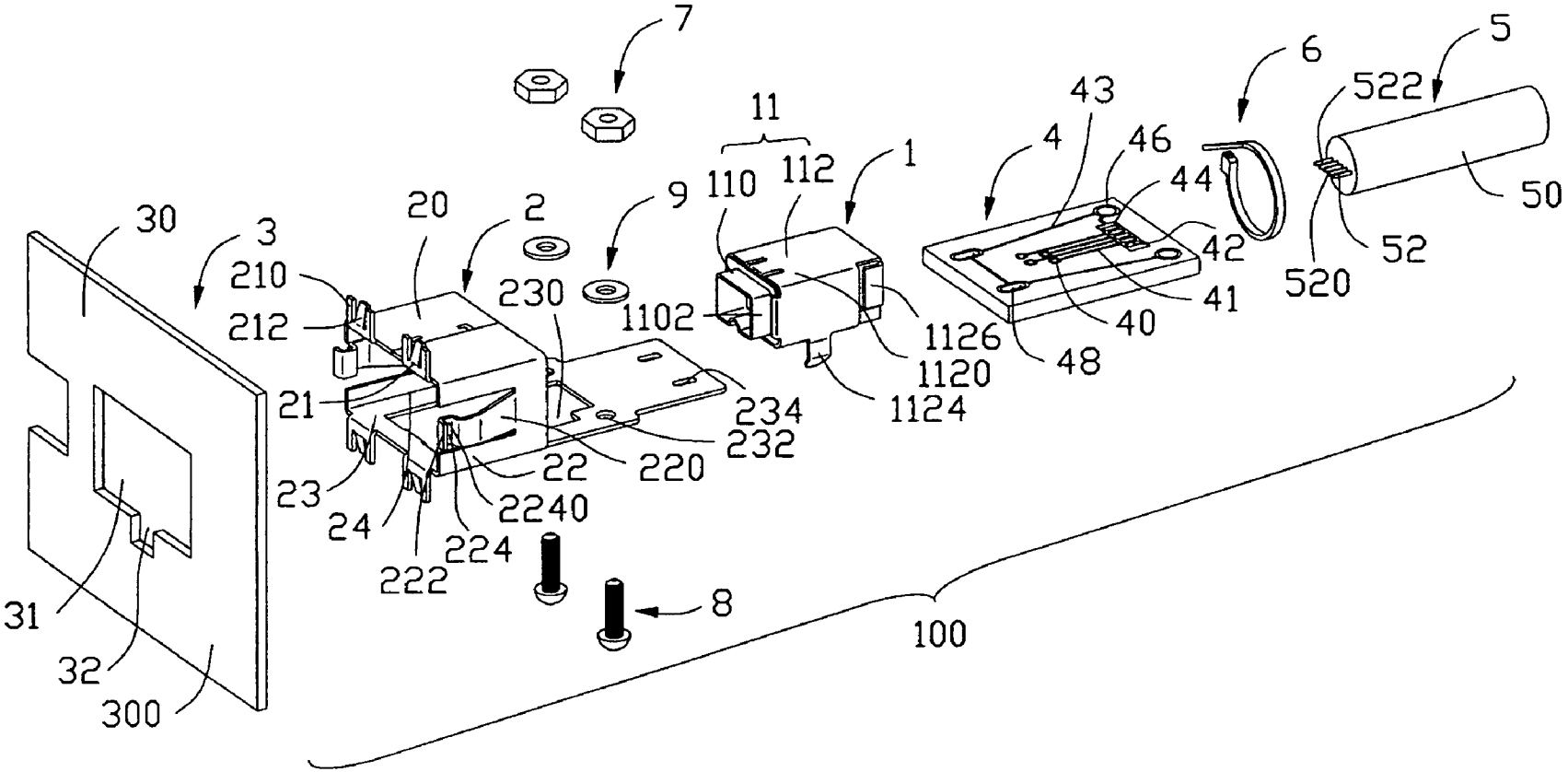
FIG. 1 is an exploded, perspective view of a cable connector assembly in accordance with the present invention.
Figure 2:
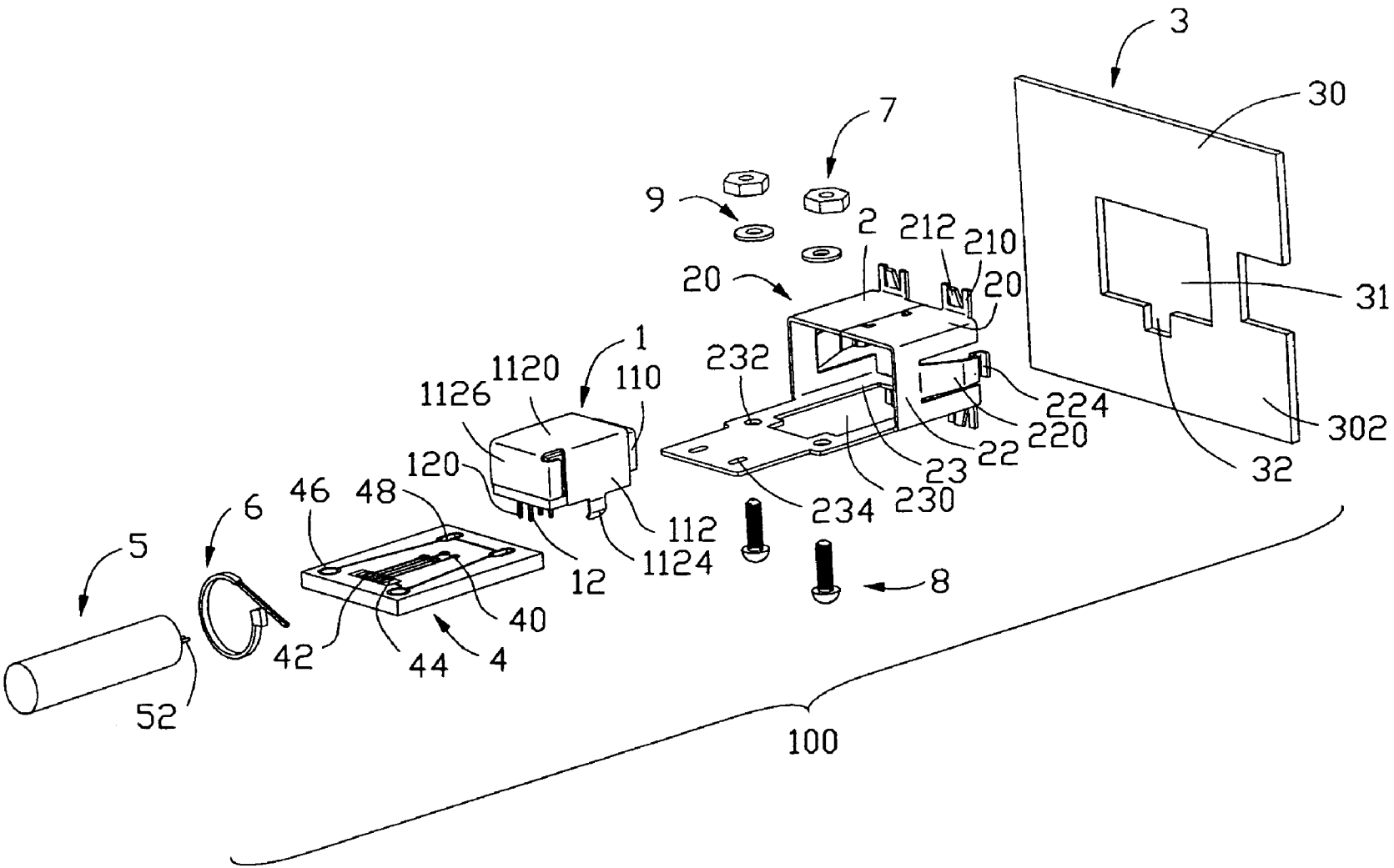
FIG. 2 is a view similar to FIG. 1, but taken from a different aspect.

Referring to FIGS. 1–2, a cable connector assembly 100 in accordance with the present invention comprises an electrical connector 1, a shielding member 2 surrounding the electrical connector 1, a panel 3, a printed circuit board 4, a cable 5, a band strip 6, a pair of screw nuts 7, a pair of screw bolts 8 and a pair of washers 9.

Figure 7:
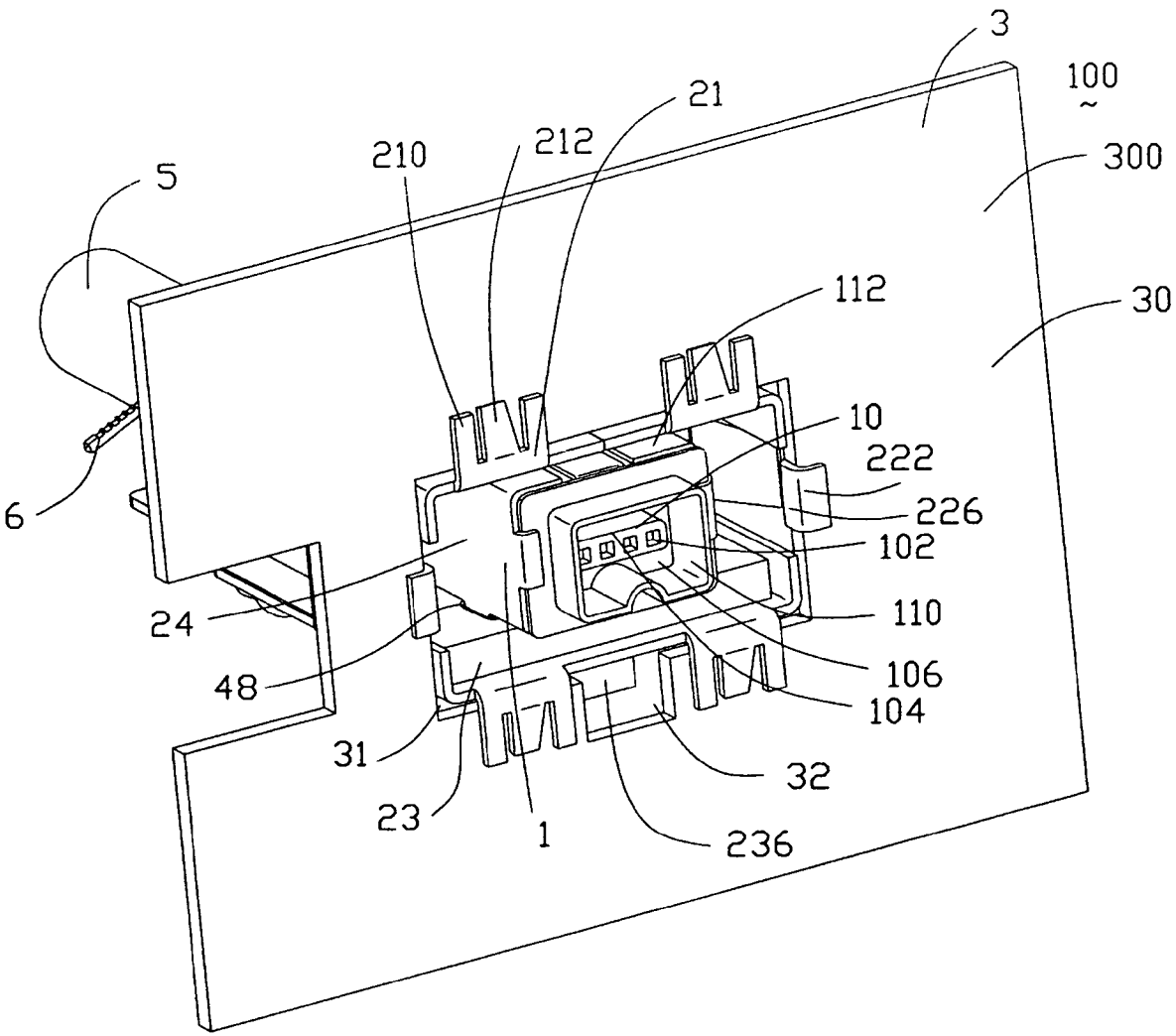
FIG. 7 is an assembled, perspective view of the cable connector assembly in accordance with the present invention.
Figure 8:
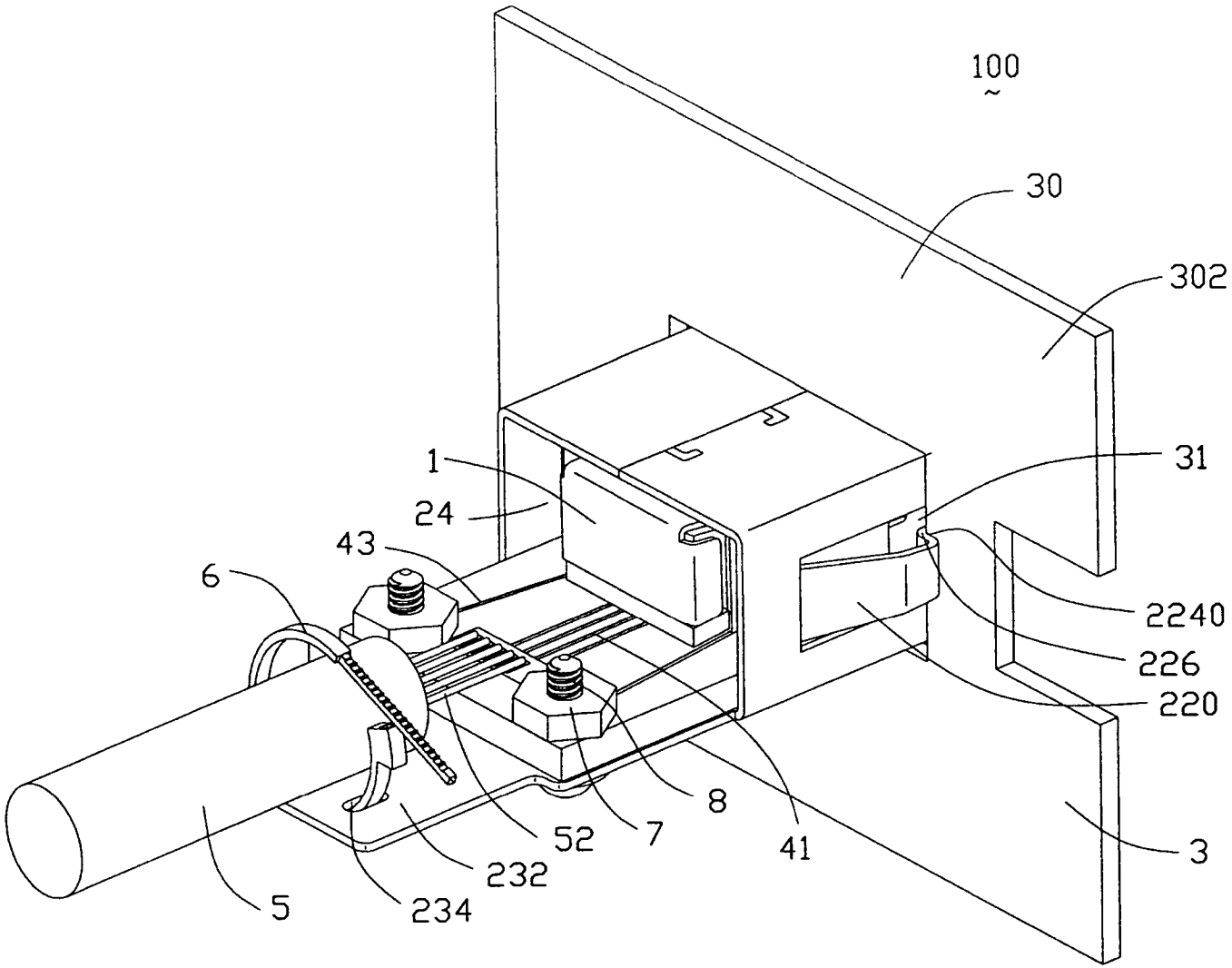
FIG. 8 is a view similar to FIG. 7, but taken from a different aspect.

Referring to FIGS. 1–2 in conjunction with FIGS. 7–8, the electrical connector 1 comprises an insulative housing 10, a plurality of conductive contacts 12 retained in the insulative housing 10, and a conductive shield 11 enclosing the insulative housing 10.

Particularly referring to FIG. 7 in conjunction with FIGS. 1–2, the insulative housing 10 comprises a rectangular body portion 106 and a tongue portion 104 extending forwardly from the body portion 106. A plurality of passageways 102 extend rearwardly from a front surface of the tongue portion 104 for receiving the conductive contacts 12.

The conductive shield 11 comprises a first shield-half 110 and a second shield-half 112 engaging with the first shield-half 110. The first shield-half 110 is configured as a substantially rectangular frame 1102 for engaging with a complementary connector. The second shield-half 112 comprises a main body 1120 enclosing the body portion 106 of the insulative housing 10, a pair of curved retaining feet 1124 extending downwardly from opposite side walls of the main body 1120 and a rear part 1126 bending vertically from a top wall of the main body 1120 to enclose a rear face of the body portion 106.

Each conductive contact 12 comprises a contacting portion (not labeled) received in a corresponding passageway 102 of the tongue portion 104 and a tail portion 120 bending vertically from the contacting portion and exposed beyond a bottom surface of the insulative housing 10 for electrically connecting with the printed circuit board 4.

The shielding member 2 comprises an upper section 20, a pair of opposite side sections 22 extending vertically from opposite sides of the upper section 20, and a lower section 23 connecting with the pair of side sections 22. A receiving space 24 is defined by the sections 20, 22, 23. Each side section 22 forms a side latch 220 extending forwardly from a rear portion of the side section 22. A U-shaped claw section 224 is formed at a front end of the side latch 220. The U-shaped claw section 224 comprises a first and an opposite second sections 222, 228 and an intermediate section 226 connecting with the first and the second sections 222, 228. The first and the second sections 222, 228 and the intermediate section 226 thus, together define a U-shaped panel-receiving space 2240. A pair of panel-retaining portions 21 extend vertically from a front edge of each of the upper and the lower sections 20, 23. Each panel-retaining portion 21 comprises a pair of anti-overstress members 210 and a deflecting member 212 located between the pair of anti-overstress members 210 and slightly bending rearwardly. The lower section 23 of the second conductive shield 2 is an enlarged flat piece and further defines a substantially rectangular opening 230 in a front portion thereof. A polarizing tab 236 (FIG. 7) bends downwardly from a front edge of the opening 230. A pair of first holes 232 and a pair of second holes 234 are respectively defined in the middle and a rear portion of the lower section 23.

The panel 3 comprises a main body 30 comprising a first face 300 and an opposite second face 302. A rectangular aperture 31 is defined in a middle of the main body 30 and a cutout 32 is defined in the main body to communicate with the aperture 31.

The printed circuit board 4 is a rectangular board and forms a plurality of signal pads 42 adjacent to a rear edge thereof and a ground pad 44 located near the signal pads 42. A pair of first ground vias 46 and a pair of second ground vias 48 are respectively defined in a rear portion and a front portion of the printed circuit board 4 and electrically connect with one another through a ground trace 43. A plurality of signal vias 40 are defined in the middle of the printed circuit board 4 and respectively electrically with the signal pads 42 through a plurality of signal traces 41. Each of the signal vias 40 and the ground vias 46, 48 is formed by a through-hole coated with conductive material.

The cable 5 comprises a plurality of conductive conductors 52 and an insulating coating 50 enclosing the conductors 52. The conductors 52 consist of a plurality of signal lines 520 and a ground line 522 corresponding to the signal and the ground pads 42, 44 of the printed circuit board 4.

In assembly, referring to FIGS. 1–4 in conjunction with FIGS. 7–8, the conductive contacts 12 are respectively received in the passageways 102 of the insulative housing 10 with the tail portions 120 exposed beyond the bottom surface of the insulative housing 10. The first and the second shield-halves 110, 112 of the conductive shield 11 are assembled to the insulative housing 10 and engage with each other. The rear part 1126 encloses the rear face of the body portion 106 of the insulative housing 10. Then the assembled electrical connector 1 is mounted on the printed circuit board 4. The retaining feet 1124 of the conductive shield 11 are received in the pair of second ground vias 48 of the printed circuit board 4 and electrically connect with the ground pad 44 through the first ground vias 46 and the ground trace 43. The tail portions 120 of the conductive contacts 12 are respectively received in the signal vias 40 and electrically connect with the signal pads 42 through the signal trace 41. The signal and the ground lines 520, 522 of the cable 5 are respectively soldered on the signal and the ground pads 42, 44 of the printed circuit board 4. Thus, the cable 5 electrically connects with the electrical connector 200 through the printed circuit board 4.

Referring to FIGS. 5–8, the electrical connector 1, the printed circuit board 4 and the cable 5 is together assembled to the shielding member 2. The electrical connector 1 is received in the receiving space 24 of the shielding member 2 with the printed circuit board 4 located upon the rectangular opening 230. The cable 5 is located on a rear portion of the lower section 23 of the shielding member 2 with the band strip 6 protruding through the pair of second holes 234 of the lower section 23 to tie the cable 5 on the shielding member 2. The pair of screw nuts 7 and the pair of washers 9 are respectively located on an upper surface of the printed circuit board 4 and a lower surface of the shielding member 2 and align with the pair of first ground vias 46. The pair of screw bolts 8 respectively protrude through the first ground vias 46 and screw with the pair of screw nuts 7. Therefore, the shielding member 2 is tightly secured with the printed circuit board 4 and the cable 5.

Figure 3:
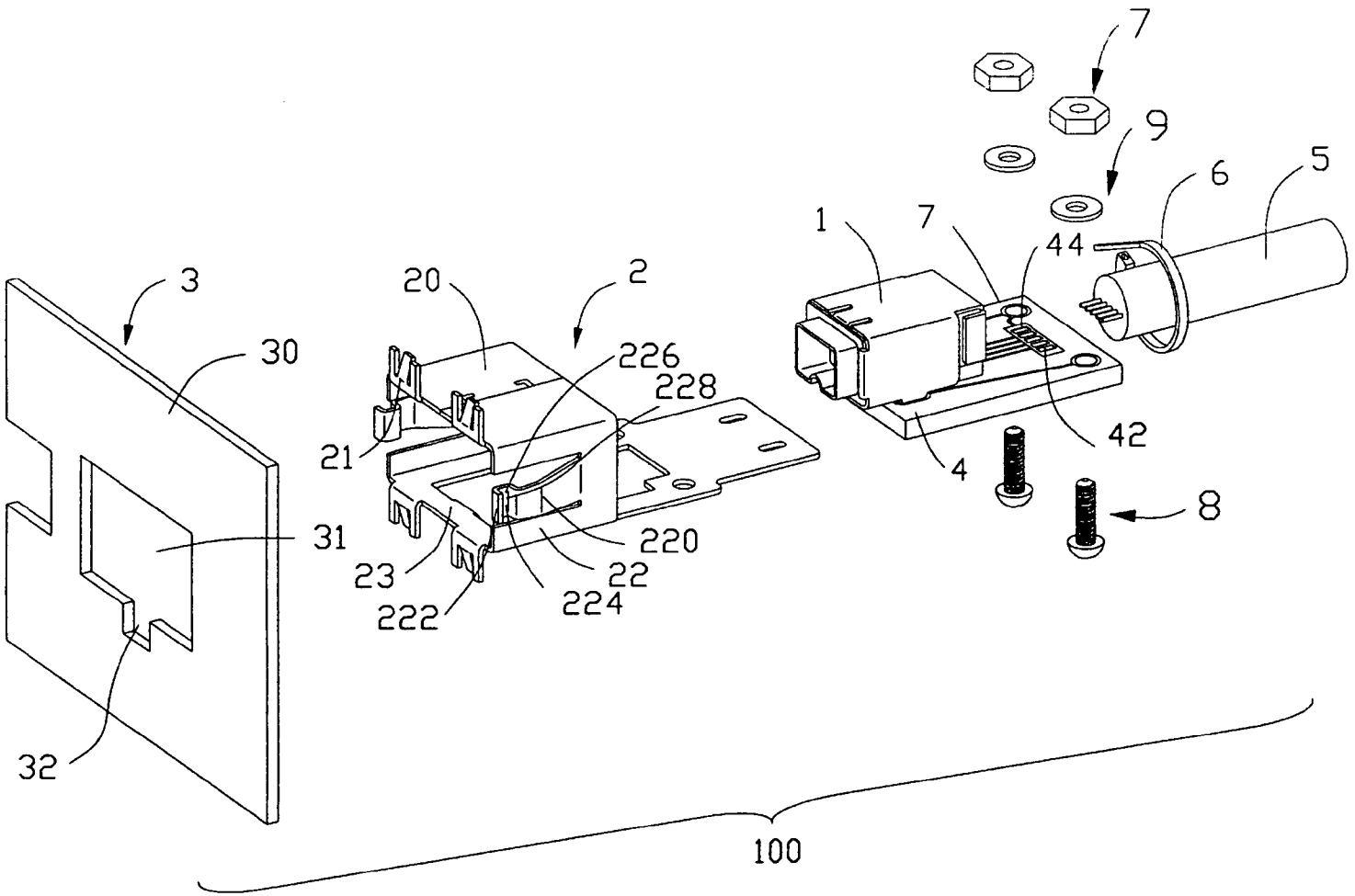
FIG. 3 is a partially assembled view of FIG. 1.
Figure 4:
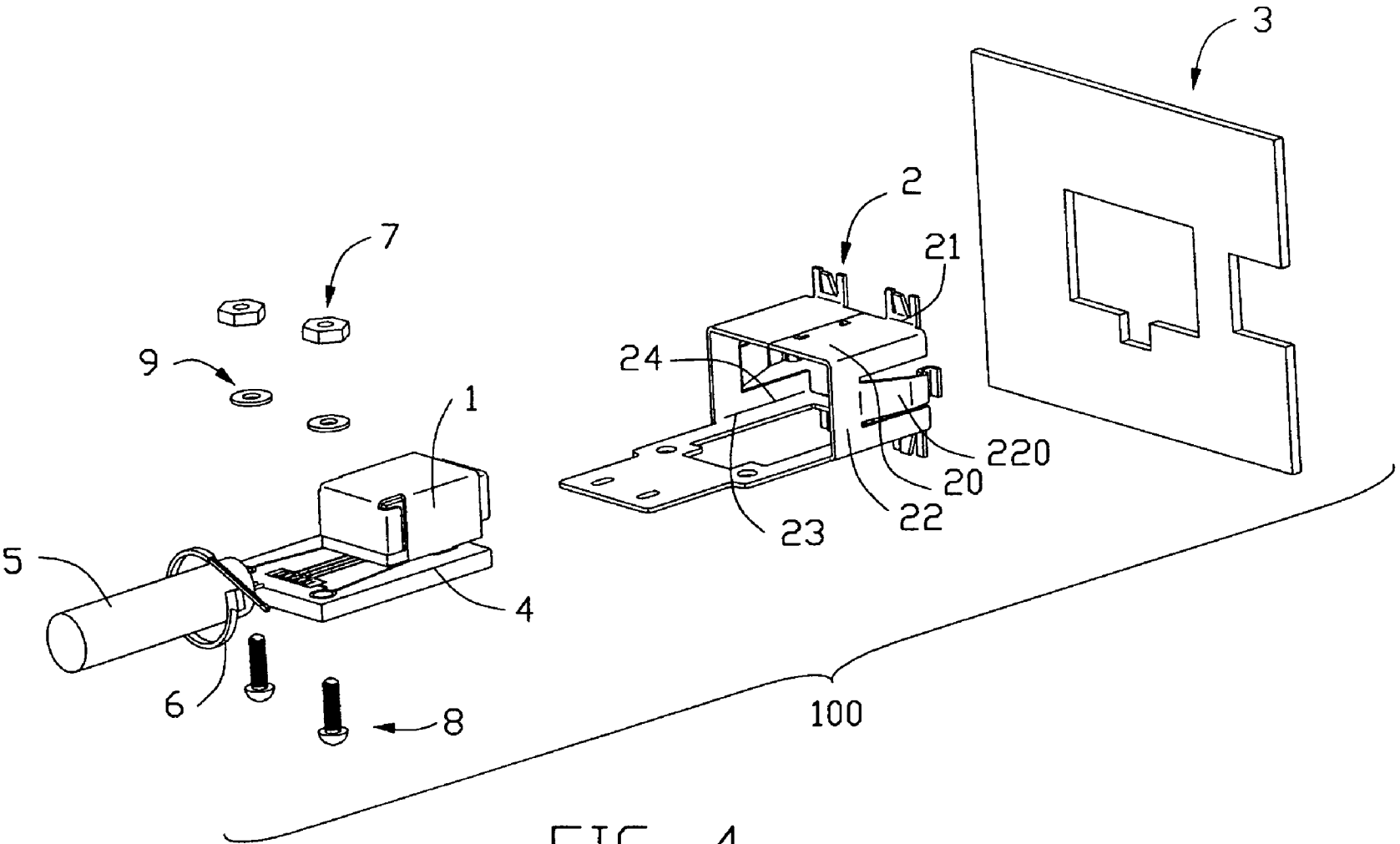
FIG. 4 is a view similar to FIG. 3, but taken from a different aspect.
Figure 5:
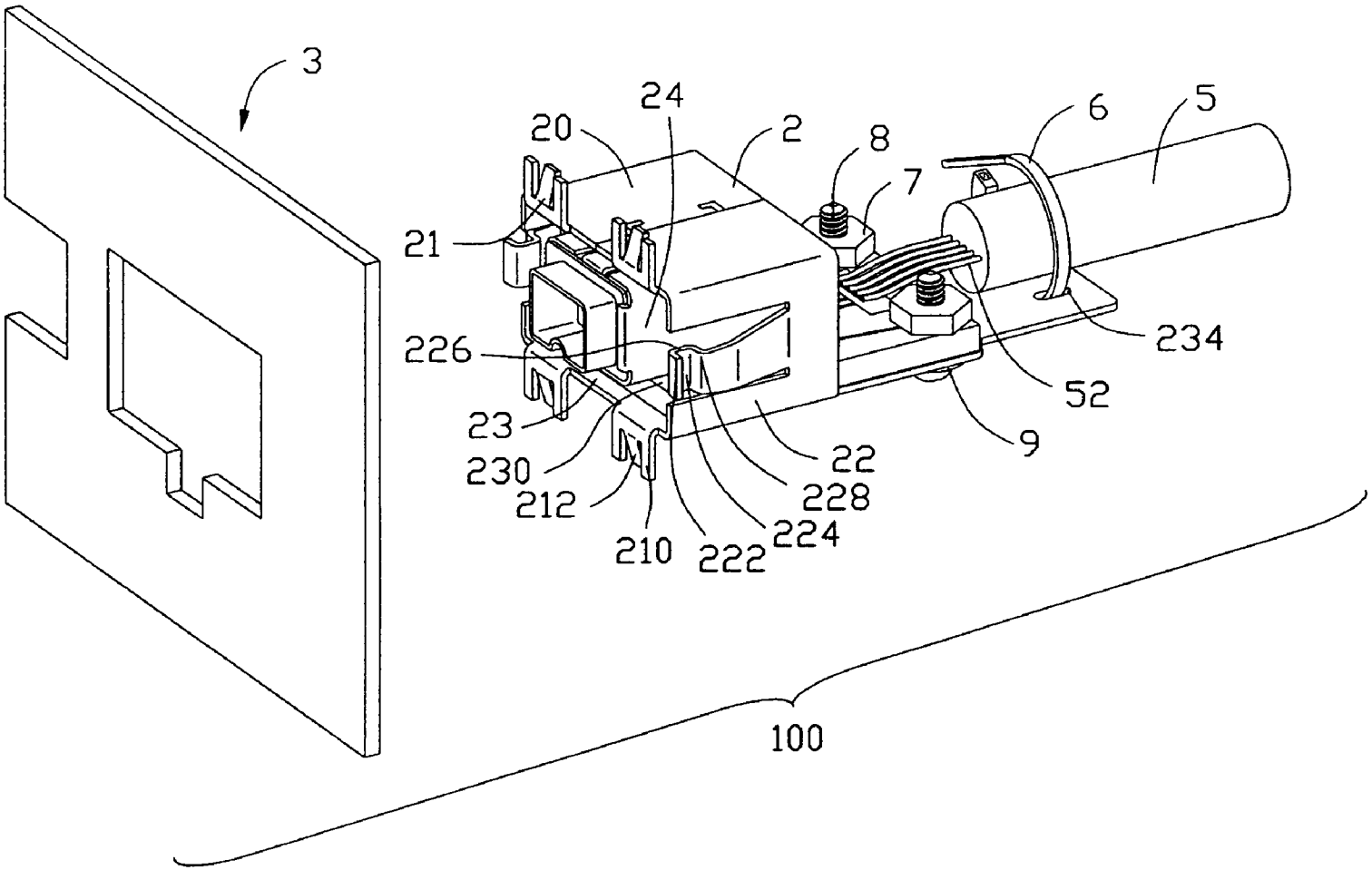
FIG. 5 is a partially assembled view of FIG. 3.
Figure 6:
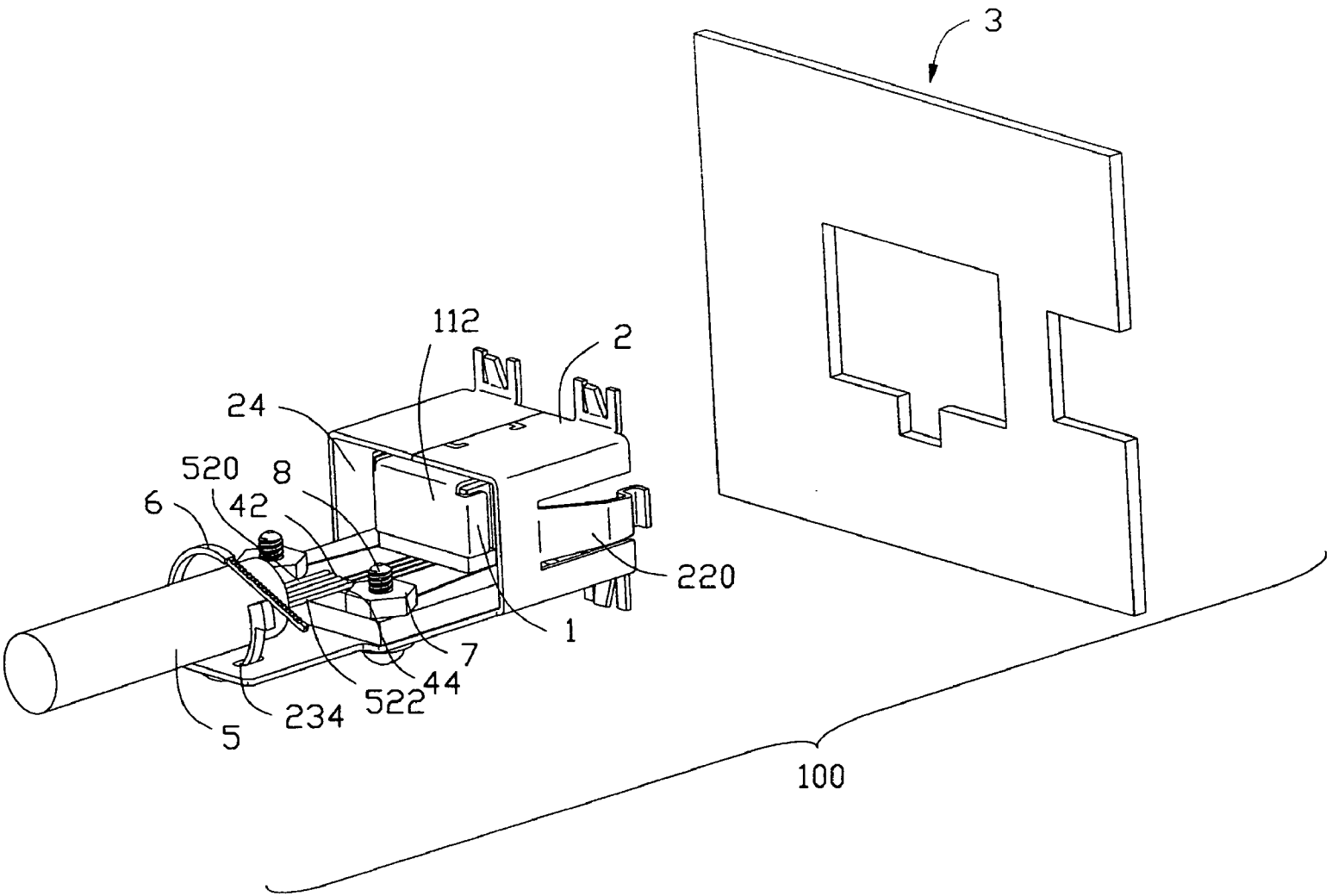
FIG. 6 is a view similar to FIG. 5, but taken from a different aspect.

Referring to FIGS. 7–8 in conjunction with FIGS. 1–3, the shielding member 2 together with the electrical connector 1, the printed circuit board 4 and the cable 5 is pulled to be assembled to the panel 3 in a front-to-back direction. The polarizing tab 236 can prevent the electrical connector 1 from being mounted to the panel 3 in a wrong direction. Finally, the panel 3 is received in the U-shaped panel-receiving spaces 2240 of the shielding member 2 with the deflecting members 212 and the first sections 222 of the claw sections 224 abutting on the first face 300 of the panel 3. The second sections 228 of the claw sections 224 abut on the second face 203 of the panel 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an electrical connector comprising:

an insulative housing;

a plurality of conductive contacts received in the insulative housing; and a conductive shield enclosing the insulative housing;

a cable comprising a plurality of conductive lines respectively electrically connecting with the conductive contacts of the electrical connector; and a shielding member comprising an upper section, a lower section and a pair of side sections which define a receiving space therebetween to receive the electrical connector, the shielding member electrically connecting with the conductive shield of the electrical connector and forming a panel-retaining portion extending vertically therefrom and adapted for engaging with a panel securely; and wherein a printed circuit board located on the lower section of the shielding member, the conductive contacts of the electrical connector and the lines of the cable respectively electrically connecting with the printed circuit board.

2. The cable connector assembly as claimed in claim 1, wherein the printed circuit board forms a ground trace thereon, and wherein the conductive shield of the electrical connector and the shielding member respectively electrically connect with the ground trace to form the electrical connection therebetween.

3. The cable connector assembly as claim in claim 1, wherein the printed circuit board defines a plurality of signal vias and forms a plurality of signal pads electrically connecting with the signal vias through a plurality of signal traces, and wherein the conductive contacts are respectively inserted into the signal vias and the lines of the cable are respectively soldered on the signal pads.

4. The cable connector assembly as claimed in claim 1, wherein each of the side sections of the shielding member forms a claw section curved forwardly therefrom, and wherein the claw section forms a panel-receiving space at a front end thereof and adapted for securing the panel therein.

5. The cable connector assembly as claimed in claim 1, wherein the lower section of the shielding member forms a polarizing tab for guiding the electrical connector to the panel in a correct direction.

6. The cable connector assembly as claimed in claim 1, wherein the insulative housing comprises a body portion and a tongue portion extending forwardly from the body portion.

7. The cable connector assembly as claimed in claim 1, wherein the conductive shield of the electrical connector comprises a first shield-half enclosing the body portion of the insulative housing and a second shield-half configured as a frame for receiving a complementary connector.

8. The cable connector assembly as claimed in clam 1, wherein the shielding member is circumferentially spaced from the conductive shield.

9. The cable connector assembly as claimed in claim 1, wherein the shielding member and the conductive shield respectively electrically connect with the printed circuit board.

10. The cable connector assembly as claimed in claim 1, wherein the printed circuit board defines a pair of first ground vias at a rear end thereof and a pair of second ground vias at a front end thereof electrically connecting with the first ground vias through a ground trace, and wherein the conductive shield of the electrical connector forms a pair of retaining feet secured in the second ground vias.

11. The cable connector assembly as claimed in claim 10, wherein the shielding member defines a pair of first holes in the lower section thereof, and wherein a pair of bolts respectively protrude through the first holes of the shielding member and the first ground vias of the printed circuit board to fasten the shielding member with the printed circuit board.

12. The cable connector assembly as claim in claim 11, wherein the shielding member defines a pair of second holes in the lower section thereof, and wherein a band strip protrudes through the second holes to secure the cable to the shielding member.

13. The cable connector assembly as claimed in claim 1, wherein the panel-retaining portion of the shielding member comprises a deflecting member extending vertically from one of the upper and the lower sections and slightly bending rearwardly.

14. The cable connector assembly as claimed in claim 13, wherein the panel-retaining portion of the shielding member forms an anti-overstress member located beside the deflecting member and vertically extending from one of the upper and the lower sections for preventing the excessive deformation of the deflecting member.

15. A cable connector assembly comprising:

an electrical connector including an insulative housing enclosed in a metal shield and enclosing a plurality of contacts therein;

a small printed circuit board on which the connector is mechanically and electrically mounted;

an outer shield defining a cavity in which the connector and the associated printed circuit board is fixedly received, and a cable including a plurality of wires mechanically and electrically mounted to said printed circuit board; wherein said outer shield is circumferentially spaced from said metallic shield and adapted to be mounted to an opening of a panel.

16. An electrical assembly comprising:

a metallic panel defining an opening therethrough in a front-to-back direction;

an outer shield defining a flange, said outer shield assembled to the panel in the front-to-back direction with said flange abutting against a front face of the panel and the outer shield extending through said opening to be located on a rear side of the panel;

an electrical connector having an insulative housing enclosed in a metallic shield and enclosing a plurality of contacts therein;

a printed circuit board detachably assembled to the outer shield on the rear side thereof and having the connector mechanically and electrically mounted thereon; and a cable having a plurality of wires mechanically and electrically connected to the printed circuit board.

17. The assembly as claimed in claim 16, wherein said outer shield further defines a deflectable arm with a locking head to fix the outer shield to the panel around the opening.

18. The assembly as claimed in claim 16, wherein said printed circuit board and the associated connector and cable are assembled to the outer shield only after the outer shield has been mounted to the panel in said front-to-back direction.

* * * * *